US005171293A

United States Patent [19]

Umemoto et al.

[11] Patent Number: 5,171,293

[45] Date of Patent: Dec. 15, 1992

[54] FUSE BOX ASSEMBLY

[75] Inventors: Hiroshi Umemoto; Brian J. Pinkelman, both of Northville, Mich.

[73] Assignee: Yazaki Corporation, Tokyo, Japan

[21] Appl. No.: 802,630

[22] Filed: Dec. 5, 1991

[51] Int. Cl.[5] ..... H01R 13/68

[52] U.S. Cl. ..... 439/622; 337/194

[58] Field of Search ..... 439/621, 622; 337/194, 337/196, 208, 209, 226

[56] References Cited

U.S. PATENT DOCUMENTS 4,178,061 12/1979 Ahroni ..... 439/622

FOREIGN PATENT DOCUMENTS 62-18947 of 1987 Japan .

2189946 11/1987 United Kingdom ..... 439/622

*Primary Examiner*—Eugene F. Desmond

*Attorney, Agent, or Firm*—Krass & Young

[57] ABSTRACT

A fuse box assembly including a fuse box and a fuse holder. The fuse holder has a saddle configuration and overlies one of the terminal sockets of the fuse box. The fuse holder includes an opening to receive the body of a fuse and the fuse holder is mounted on the fuse box for movement between an operative position in which the terminal tabs of the fuse are received in the associated terminal socket of the fuse box and a raised, inoperative position in which the terminal tabs of the fuse are removed from the terminal socket. The holder includes a pair of legs which extend downwardly along opposite side walls of the fuse box and which include slots which coact with pins on the side walls of the fuse box to provide a detenting action to positively maintain the holder in its raised, inoperative position. The holder serves to readily identify those fuses which must be moved to an inoperative position to avoid draining the associated energy source during periods of non-use of the associated electrical system; maintains the displaced fuse in a known position during the periods of non-use; and allows the fuse to be readily reinserted into the terminal socket of the fuse box at the conclusion of the period of non-use.

19 Claims, 2 Drawing Sheets

FIG-1
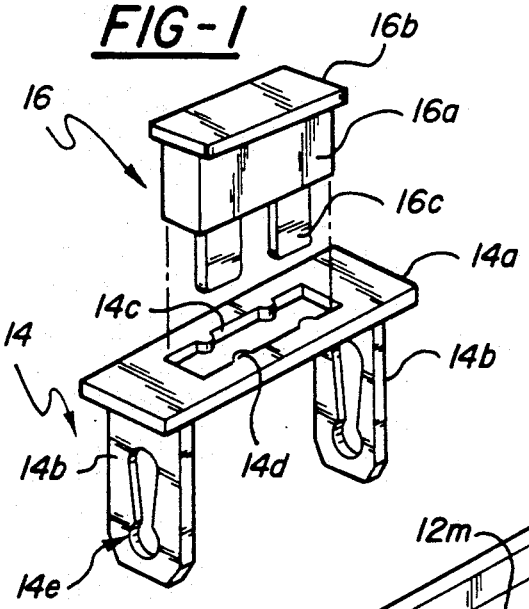
FIG-2
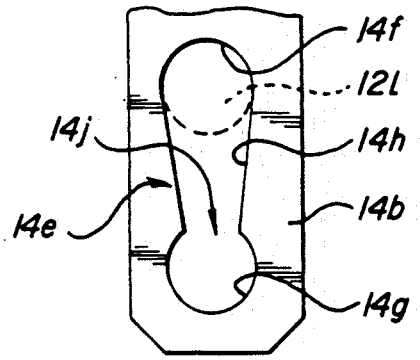
FIG-3
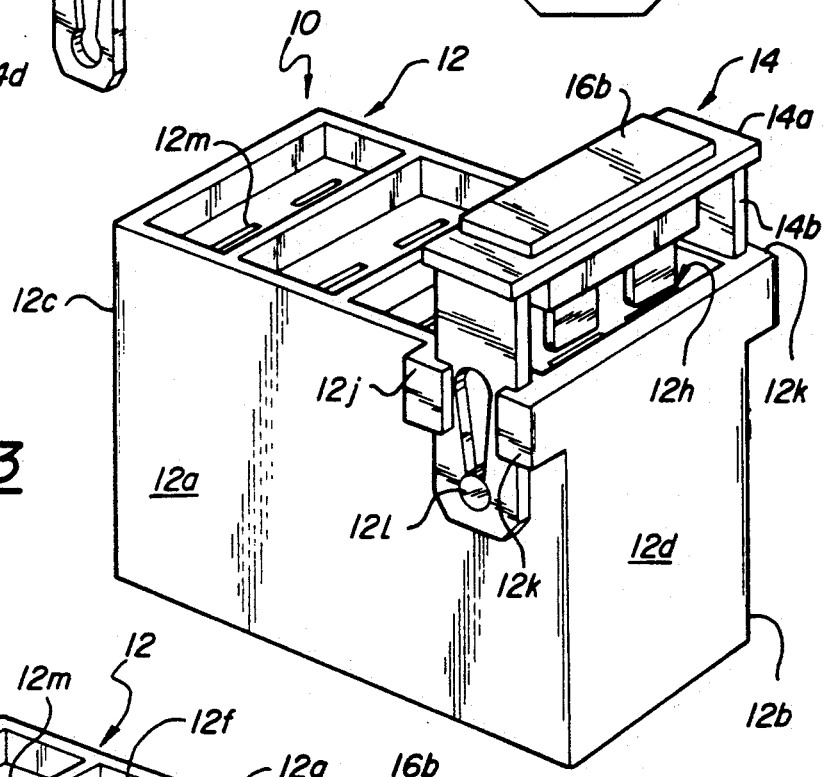
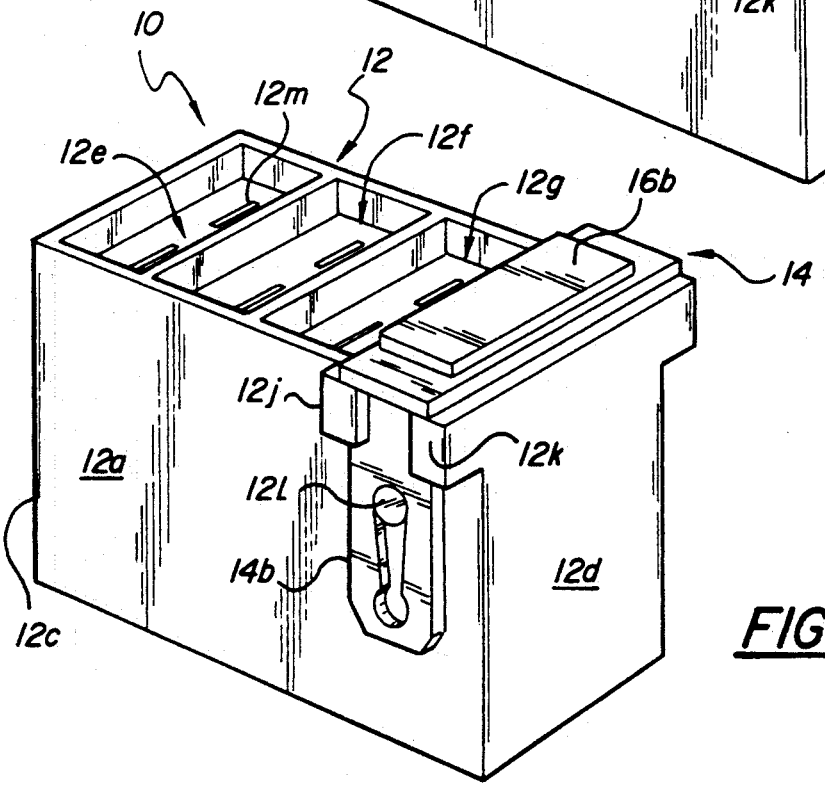
FIG-4

FIG-5
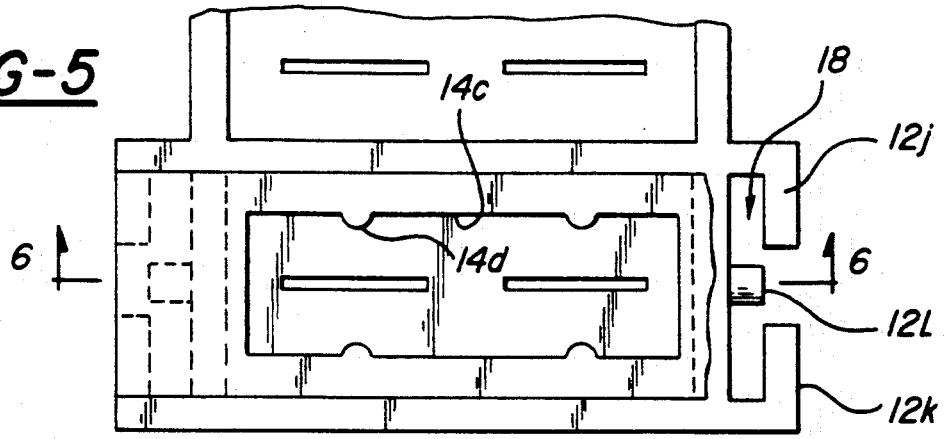
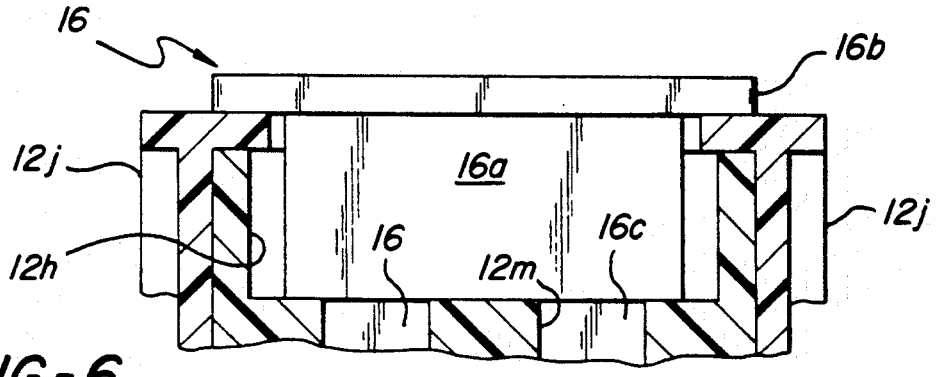
FIG-6
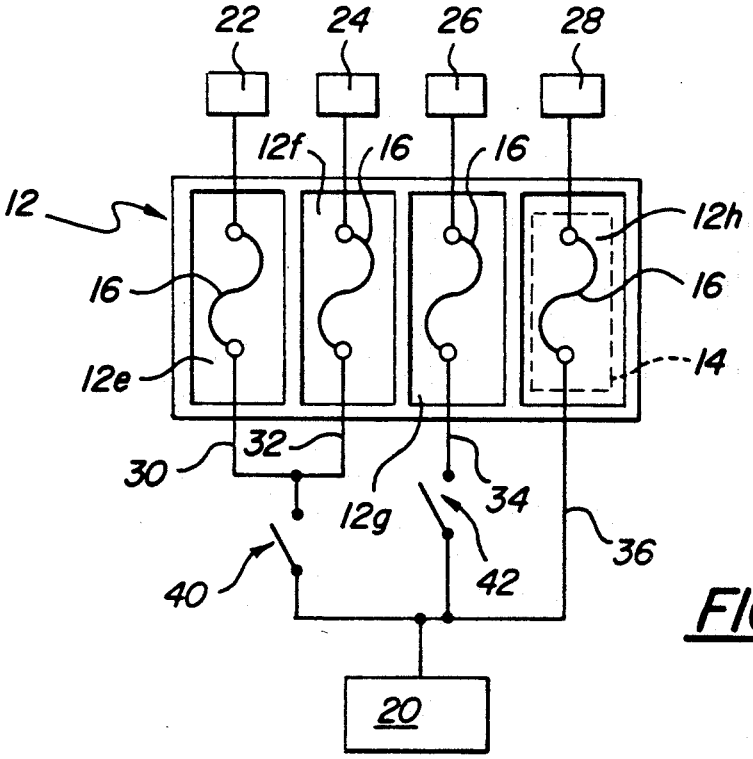
FIG-7

FUSE BOX ASSEMBLY

INTRODUCTION

This invention relates to automotive fuse box assemblies and more particularly to a multiple-fuse box in which at least certain of the fuses are provided with a holder which is essentially fixedly attached to the fuse but displaceably attached to the fuse box to permit the fuses so equipped to be withdrawn from their associated electrical circuits yet kept in a position which facilitates reinsertion and, at the same time, reduces the likelihood that the withdrawn fuse will be misplaced or lost.

Fuses are commonly used to provide electrical overload protection in the various circuits of an automobile. Many automobile owners have had the experience of locating the fuse box and replacing a blown fuse for the purpose of restoring an automotive circuit to operability.

Some of the automotive circuits are equipped with switches by which the operator of the automobile selectively controls the activation or deactivation of the load device; e.g. headlights, turn signals and radio. However, some circuits are effectively permanently connected to the vehicle battery without the inclusion of intervening switches. Therefore, these devices essentially continuously draw current from the vehicle battery and can ultimately seriously reduce the starting power available from the battery if left connected in an unused vehicle over a extended period of time.

It is common for the manufacturer or shipper or the owner of a vehicle which for various reasons will not be started and driven for an extended period of time to simply remove the fuse which is associated with the electrical load device which might otherwise drain the vehicle battery. Another alternative, of course, is to disconnect the battery but this is often a less convenient alternative due to battery location, desire to periodically start and move the vehicle a small distance and so forth.

Various devices have been employed to facilitate the identification of the fuses that are associated with circuits connected directly to the battery so as to facilitate the removal of these fuses during periods of non-use. For example, in Japanese Preliminarily Published Utility Model Application No. 62-18947, published on Feb. 4, 1987, the specific female socket associated with a circuit connected directly to the battery is raised above the level of the other female sockets so that the fuse controlling this circuit is also raised above the level of the other fuses and can be readily identified for purposes of temporary removal during periods of non-use. Whereas this arrangement is effective in identifying the fuse or fuses that must be removed, it suffers from the disadvantage that it includes no provision for temporarily storing the removed fuse so that the removed fuse may easily be lost or misplaced during the period of non-use of the motor vehicle.

SUMMARY OF THE INVENTION

An objective of the present invention is to provide an automotive fuse box assembly capable of effectively electrically providing fuses in multiple automotive electrical circuits wherein at least some of the fuses are especially adapted to be temporarily withdrawn from their electrical circuits and yet kept in a readily available position for reinsertion. In general, this is accomplished through the use of one or more specially designed fuse holders which are essentially fixedly attached to the associated fuse, but displaceably attached to the fuse box so as to permit the associated fuse to be easily withdrawn from the electrically connected position and held in a second, non-connected position where it can be readily and conveniently restored to the first connected position by a simple manipulation when the manufacturer, shipper, owner or other appropriate person is ready to reactivate the associated electrical load device.

As will be apparent from a reading of the following specification, the term "fixedly attached," as used to define the association between the fuse holder and the fuse herein, is intended in a relative sense; i.e., the two elements need not be permanently attached but are associated in such a way that movements of the fuse and holder relative to the fuse box are necessarily simultaneous.

The fuses disclosed herein for purposes of illustration or the currently conventional automotive fuses of the type having a pair of bayonet-type connectors projecting in parallel from a molded plastic body which is typically marked with the electrical capacity of the fuse.

Briefly summarizing an illustrative embodiment of the invention, the fuse box has terminal sockets which open upwardly to receive the bayonet connectors of the fuses, the displaceable holder has a saddle configuration including a base adapted to overlie the associated terminal socket, and a pair of legs extending downwardly from the base proximate opposite side walls of the box. A slot is provided in at least one of the legs for detenting coaction with a pin carried by the side wall of the fuse box. This arrangement provides a simple and effective means of slideably moving the fuse between its connected and disconnected positions while providing a positive detenting action in the disconnected, displaced position. In the disclosed embodiment of the invention, each of the holder legs has a slot and a coacting pin is provided on each of the opposite side walls of the fuse box.

In the illustrative embodiment, the holder is mounted on the fuse box for movement between its operative and inoperative positions by means defining a guide slot proximate each opposite side wall of the fuse box for respective sliding and guiding receipt of the legs of the holder. This arrangement provides a simple and effective means for guiding the holder in its movement between its operative and inoperative positions.

As hereinafter described, the fuse box assembly illustrated is designed to receive fuses of conventional design in which a plastic body encapsulates the fuse element and from which the bayonet connectors extend in parallel fashion. The holder is provided with a bridge portion which extends between the legs to overlie the fuse socket. The bridge portion of the holder is adapted to receive the fuse in an orientation which facilitates insertion into and removal from the sockets by lowering and raising the holder and the fuse as a unit. Moreover, the holder is configured such that the rating indicia on the top of the fuse can be read while the fuse is in the holder.

The invention also provides an electrical system including a plurality of circuits extending respectively between a source of electrical energy and a plurality of electrical devices with some but not all of the circuits controlled by separate switch means. The invention electrical system includes a source of electrical energy; a plurality of electrically operated devices; a plurality of circuits respectively connecting the source and the devices; switch means controlling some but not all of the circuits so as to leave at least one circuit directly connected to the source without an intervening switch means; a fuse box including a plurality of terminal sockets respectively connected to the circuits for coaction with a plurality of fuses having bayonet connectors for receipt in the sockets to complete the respective electrical circuits through the respective fuses; a fuse holder associated with the specific terminal socket connected to the one circuit and including means for receiving a fuse; and means mounting the fuse holder for movement between an operative position proximate the fuse box in which the bayonet connectors of the fuse are received in the specific terminal socket and an inoperative position displaced from the fuse box in which the bayonet connectors of the fuse are removed from the specific terminal socket. With this arrangement, when the electrical system is not in use, the holder may be moved to its disconnected position to remove the fuse and preclude draining of the electrical energy source through the circuit connected directly to the energy source and when it is thereafter desired to place the electrical system in use the holder may be moved to its connected position to reinsert the fuse and complete the directly connected circuit.

BRIEF DESCRIPTION OF THE DRAWINGS

FIG. 1 is an exploded view of a fuse and fuse holder employed in the invention fuse box assembly;

FIG. 2 is a detailed view of a portion of the fuse holder seen in FIG. 1;

FIG. 3 is a perspective view of the invention fuse box assembly showing the fuse holder in an inoperative displaced position relative to the fuse box;

FIG. 4 is a perspective view of the invention fuse box assembly showing the fuse holder in an operative position proximate the fuse box;

FIG. 5 is a fragmentary plan view of the invention fuse box assembly showing the holder without a fused position therein;

FIG. 6 is a cross-sectional view taken on line 6—6 of FIG. 5 and including a fuse positioned within the fuse holder; and FIG. 7 is a diagrammatic view of an electrical system embodying the invention fuse box assembly.

DETAILED DESCRIPTION OF THE PREFERRED EMBODIMENT

The invention fuse box assembly 10, broadly considered, includes a fuse box 12 and a fuse holder 14.

The invention fuse box assembly is intended for use with fuses 16 of the type including a main body 16*a*, a flanged head 16*b* at the upper end of the body 16*a*, and a pair of bayonet connector tabs 16*c* extending downwardly from the lower end of the body. Body 16*a* and flanged head 16*b* are formed of a suitable moldable dielectric material and tabs 16*c* are formed of a suitable conductive material and are electrically connected within body 16*a*, in known manner, by a suitable fusible link.

The fuse box 12 is formed of a plastic or other moldable dielectric material and has a generally rectangular configuration including side walls 12*a* and 12*b* and end walls 12*c* and 12*d*. A plurality of upwardly opening female terminal sockets 12*e, f, g* and *h* are provided in serial relation at the upper end of the fuse box and a pair of opposed guide members 12*j* and 12*k* are formed integrally with the upper edge of the fuse box at opposite sides of socket 12*h* with each pair of guide members 12*j* and 12*k* coacting to define a vertical guide slot 18. A pin 12*l* of circular cross section is formed integrally with each fuse box side wall 12*a*, 12*b* in respective underlying vertically aligned relation to a guide slot 18. Each terminal socket 12*e*, 12*f*, 12*g* and 12*h* includes, in known manner, a pair of receptacle slots 12*m* for plugging receipt of the bayonet connector tabs 16*c* of a fuse 16.

Fuse holder 14 is also formed from a plastic or other moldable dielectric material and includes a horizontal bridge portion 14*a* and a pair of leg portions 14*b* extending in parallel downwardly proximate opposite ends of the base portion. Holder 14 will be seen to have a saddle configuration with an inverted U shape.

Base portion 14*a* has a generally rectangular configuration and includes a central rectangular opening 14*c* having a size and configuration generally corresponding to the cross-sectional configuration of the body 16*a* of a fuse 16. Specifically, opening 14*c* is sized to slidably pass the body 16*a* of a fuse 16 but is too small to pass the flanged head 16*b* of the fuse so that the fuse may be inserted into the holder by inserting the fuse through the opening 14*c*, bayonet connector tabs first, to pass the fuse body through the opening and position the flanged head 16*b* against the upper face of base portion 14*a*. A plurality of integral nubs 14*d* are provided around the periphery of opening 14*c* so as to frictionally engage the side walls of the body 16*a* of the fuse as the fuse is inserted into the holder so as to frictionally maintain the fuse in its inserted position in the holder and permit the fuse and holder to be raised and lowered as a unit.

A vertical slot 14*e* is provided in each leg 14*b* of the holder. Each slot 14*e* includes an upper semi-circular portion 14*f* having a diameter slightly exceeding the diameter of a pin 12*l*; a lower circular portion 14*g* having a diameter slightly exceeding the diameter of a pin 12*l*; and converging straight edge portions 14*h* which connect tangentially at their upper ends with upper semi-circular portion 14*f* and which coact at their lower ends with lower circular portion 14*g* to define a neck 14*j* sized to detentingly pass a pin 12*l*.

In the assembled relation of the holder and fuse box, leg portions 14*b* of the holder pass respectively downwardly through vertical guide slot 16 with the pins 12*l* respectively received in the slots 14*e*. It will be seen that the holder is mounted for displacement relative to the fuse box between a lowered, fuse-operative position seen in FIG. 4 and a raised, fuse-inoperative position seen in FIG. 3.

In the operative position seen in FIG. 4, the base portion 14*a* of the holder is seated on the top edge of the fuse box over the terminal socket 12*h* with the terminal tabs 16*c* of the fuse 16 received in the opening 14*c* of the holder received in the receptacle sockets 12*m* of terminal socket 12*h* so as to establish electrical communication through the fuse and complete the electrical circuit associated with the socket 12*h*. In this operative position of the holder, pins 12*l* are seated in the upper semi-circular portions 14*f* of the slots 14*e* in the leg portions of the holder.

In the inoperative position of FIG. 3, the holder has been pulled upwardly from its operative position of FIG. 4 to remove the terminal tabs 16*c* of the fuse 16 from the receptacle slots 12*m* and break the circuit associated with terminal socket 12*h*. As the holder is moved upwardly to its inoperative position, legs 14*b* guide slidably in guide slots 18 and pins 12*l* pass through the neck portions 14*j* of the slots 14*e* so that the pins move with a snapping detent action into the circular portions 14*g* at the bottoms of the guide slots so as to positively maintain the holder in its raised, inoperative position and preclude inadvertent movement of the holder to its operative position. When it is desired to move the holder back to its operative position, the holder is simply pressed downwardly to pass the pins 12*l* upwardly through the necks 14*j* of the slots 14*e* and allow the holder to move downwardly, guided in guide slots 18, to its operative position seen in FIG. 4.

The operation of the invention fuse box assembly in an electrical system is illustrated in FIG. 7. The electrical system seen in FIG. 7 is associated with a motor vehicle and includes a battery 20; a plurality of electrical devices 22, 24, 26, and 28 comprising components of the motor vehicle; and leads 30, 32, 34, and 36 extending between the battery and the respective devices 22, 24, 26, and 28.

The invention fuse box 12 is positioned in the system with terminal socket 12*e* interposed in lead 30; terminal socket 12*f* interposed in lead 32; terminal socket 12*g* interposed in lead 34; and terminal socket 12*h* interposed in lead 36. A switch 40 is provided to control leads 30 and 32 and thereby devices 22 and 24; a switch 42 is provided to control lead 34 and thereby device 26; and device 28 is connected directly to the battery 20 through the fuse box without intervention of any switch means. Device 28 may comprise, for example, a clock mounted in the instrument panel of the motor vehicle.

During periods of non-use of the motor vehicle, such as the period of time between manufacture of the vehicle and delivery of the vehicle to the ultimate customer, or during extended periods when the vehicle is not driven, the switches 40 and 42 remain in their normally open position so as to preclude draining of the battery 20 through the devices 22, 24, and 26 but the directly connected clock 28 will drain the battery if the associated fuse 16 is left in place. According to the invention, the holder 14 is simply moved to its inoperative position as seen in FIG. 3 during these period of extended non-use to remove the fuse from the associated terminal socket and preclude draining of the battery whereafter, at the conclusion of the period of non-use, the fuse may be readily and quickly restored to its operative position by simply pushing down on the holder to move the holder to its lowered operative position, seen in FIG. 4, in which the connector tabs of the fuse have again been inserted into the receptacle slots of the terminal socket of the fuse box to restore power to the clock.

The invention fuse box assembly will be seen to provide an extremely simple and inexpensive structure whereby those fuses which must be moved to an inoperative position during periods of non-use of the associated electrical system may be readily identified; the inoperative fuses may be maintained in a "ready" position during the period of non-use; and the inoperative fuses may be quickly returned to their operative positions at the conclusion of the period of non-use simply by pushing them back into their sockets.

Whereas a preferred embodiment of the invention has been illustrated and described in detail, it will be apparent that various changes may be made in the disclosed embodiment without departing from the scope or spirit of the invention. For example, some automotive fuses do not have flanged heads; rather such fuses have sets of parallel guide slots formed in the opposite side faces of the plastic bridge portion. The LF TM "mini" fuse is so configured. In this case, the holder 14 has an opening in the bridge portion 14*a* and two sets of ribs within the opening to fit into the guide slots to both secure the fuse in the holder and limit its downward travel relative to the holder. Other arrangements with similar objectives will be apparent to skilled artisans.

We claim:

1. An automotive fuse box assembly comprising:

a fuse box having a plurality of terminal sockets adapted to be associated with respective automotive electrical circuits and for receiving in electrical association therewith respective fuses having bayonet connector tabs;

fuse holder means adapted to receive a fuse in essentially fixed association therewith; and means for mounting said fuse holder on the fuse box for displacement relative thereto between a first position in which the bayonet connectors of the fuse are electrically connected into the fuse box socket and a second position in which the bayonet connectors of the fuse are disconnected from the associated terminal socket.

2. A fuse box assembly according to claim 1 wherein the assembly includes coacting detent means on said box and on said holder operative to maintain said holder in its inoperative, displaced position.

3. A fuse box assembly according to claim 2 wherein said detent means comprises a pin and a coacting slot.

4. A fuse box assembly according to claim 3 wherein said pin is carried by the fuse box and said slot is provided by the holder.

5. A fuse box assembly according to claim 1 wherein the terminal sockets open upwardly at the upper end of the fuse box, the holder has a saddle configuration including a base adapted to overlie said one socket and a pair of legs extending downwardly from said base proximate opposite side walls of the box, and a slot is provided in at least one of said legs for detenting coaction with a pin carried by the respective side wall of the box.

6. A fuse box assembly according to claim 5 wherein each of said legs has a slot and a coacting pin is provided on each of said opposite side walls of said box.

7. A fuse box assembly according to claim 5 wherein the holder is mounted on the fuse box for movement between its operative and inoperative positions by means defining a guide slot proximate each of said opposite side walls for respective sliding and guiding receipt of said legs.

8. A fuse box assembly according to claim 5 wherein the assembly is intended for use with fuses having a main body from which the terminal tabs extend and wherein the holder base includes an opening dimensioned to receive and hold the fuse so that a fuse may be mounted in the holder by inserting the fuse through the opening in the base, terminal tabs first, to pass the fuse body through the opening.

9. A fuse box assembly according to claim 8 wherein means are provided adjacent the periphery of said opening to frictionally engage the main body of the fuse to maintain the fuse in its inserted position in the holder.

10. A fuse box assembly for coaction with fuses of the type having a main body, a flanged head at one end of the main body, and terminal tabs projecting from the other end of the main body, said assembly comprising:

a fuse box defining a plurality of terminal sockets for respective receipt of a plurality of fuses to control a plurality of electrical circuits;

a fuse holder including means for receipt of a fuse; and means mounting the fuse holder on the fuse box for movement between an operative position proximate the fuse box in which the terminal tabs of the fuse are received in one of said sockets and an inoperative position displaced from the fuse box in which the terminal tabs of the fuse are removed from the socket.

11. A fuse box assembly according to claim 10 wherein the assembly includes coacting detent means on said box and on said holder operative to maintain said holder in its inoperative displaced position.

12. A fuse box assembly according to claim 11 wherein said detent means comprises a pin and a coacting slot.

13. A fuse box assembly according to claim 12 wherein said pin is carried by the fuse box and said slot is provided by the holder.

14. A fuse box assembly according to claim 10 wherein the terminal sockets open upwardly at the upper end of the fuse box, the holder has a saddle configuration including a base adapted to overlie said one socket and a pair of legs extending downwardly from said base proximate opposite side walls of the box, and a slot is provided in at least one of said legs for detenting coaction with a pin carried by the respective side wall of the box.

15. A fuse box assembly according to claim 14 wherein each of said legs has a slot and a coacting pin in provided on each of said opposite side walls of said box.

16. A fuse box assembly according to claim 14 wherein the holder is mounted on the fuse box for movement between its operative and inoperative positions by means defining a guide slot proximate each of said opposite side walls for respective sliding and guiding receipt of said legs.

17. A fuse box assembly according to claim 14 wherein the holder base includes an opening large enough to pass the fuse main body but too small to pass the flanged head so that a fuse may be mounted in the holder by inserting the fuse through the opening in the base, terminal tabs first, to pass the fuse body through the opening and position the flanged head against the holder base.

18. A fuse box assembly according to claim 17 wherein means are provided around the periphery of said opening to frictionally engage the main body of the fuse to maintain the fuse in its inserted position in the holder.

19. An electrical system including:

a source of electrical energy;

a plurality of electrically operated devices;

a plurality of circuits respectively connecting said source and said devices;

switch means controlling some but not all of said circuits so as to leave at least one circuit directly connected to the source without an intervening switch means;

a fuse box including a plurality of terminal sockets respectively connected to said circuits for coaction with a plurality of fuses having terminal tabs for receipt in the sockets to complete the respective electrical circuits through the respective fuses;

a fuse holder associated with the specific terminal socket connected to said one circuit and including means for receiving a fuse; and means mounting the fuse holder on the fuse box for movement between an operative position proximate the fuse box in which the terminal tabs of the fuse are received in said specific terminal socket and an inoperative position displaced from the fuse box in which the terminal tabs of the fuse are removed from said specific terminal socket;

whereby when the electrical system is not in use the holder may be moved to its inoperative position to preclude draining of the electrical energy source through said one circuit and when it is thereafter desired to place the electrical system in use the holder may be moved to its operative position to complete said one circuit.

* * * * *